US005746586A

United States Patent [19]

Fukuhara et al.

[11] Patent Number: 5,746,586

[45] Date of Patent: May 5, 1998

[54] SCROLL COMPRESSOR HAVING POSITIONING MEANS FOR AXIALLY MOVABLE NON-ORBITING SCROLL

[75] Inventors: Hiroyuki Fukuhara; Sadayuki Yamada, both of Otsu; Shigeru Muramatsu, Kusatsu, all of Japan

[73] Assignee: Matsushita Electric Industrial Co., Ltd., Osaka, Japan

[21] Appl. No.: 682,263

[22] Filed: Jul. 17, 1996

[30] Foreign Application Priority Data

Jul. 18, 1995 [JP] Japan ..... 7-181295

[51] Int. Cl.[6] ..... F04C 18/04

[52] U.S. Cl. ..... 418/55.2; 418/55.5; 418/57

[58] Field of Search ..... 418/55.2, 55.5, 418/57

[56] References Cited

U.S. PATENT DOCUMENTS

| | | | |
|---|---|---|---|
| 3,924,977 | 12/1975 | McCullough | 418/55.2 |
| 5,192,202 | 3/1993 | Lee | 418/55.5 |
| 5,346,376 | 9/1994 | Bookbinder et al. | 418/55.5 |
| 5,468,130 | 11/1995 | Yamada et al. | 418/55.2 |

FOREIGN PATENT DOCUMENTS

| | | | |
|---|---|---|---|
| 3237283 | 10/1991 | Japan | 418/55.5 |
| 6-81781 | 3/1994 | Japan | 418/55.5 |

*Primary Examiner*—John J. Vrablik
*Attorney, Agent, or Firm*—Wenderoth, Lind & Ponack

[57] ABSTRACT

A scroll compressor has a closed vessel, a compression mechanism accommodated in the closed vessel and including a non-orbiting scroll and an orbiting scroll in engagement with each other, and an electric motor for driving the compression mechanism. The non-orbiting scroll includes a frame portion and a non-orbiting end plate axially movable relative to the frame portion. The frame portion has a recess defined therein and a pin secured thereto. The non-orbiting end plate has a cylindrical wall integrally formed therewith and loosely received in the recess, thereby radially positioning the non-orbiting end plate relative to the frame portion. The non-orbiting end plate also has a recess defined therein in which the pin is loosely received, thereby circumferentially positioning the non-orbiting end plate relative to the frame portion. The pin is hardened so as to have a Rockwell hardness of more than 35 on scale C and has a chemical compound layer deposited thereon, to thereby minimize wear thereof.

28 Claims, 3 Drawing Sheets

SCROLL COMPRESSOR HAVING POSITIONING MEANS FOR AXIALLY MOVABLE NON-ORBITING SCROLL

BACKGROUND OF THE INVENTION

1. Field of the Invention

The present invention relates to a scroll compressor suited for use in, for example, an air conditioner, a refrigerator or the like for business or domestic use.

2. Description of Related Art

Electrically-operated compressors are available in various types including a reciprocating type, a rotary type, a scroll type, and the like, and are widely used in air conditioners, refrigerators and the like for business or domestic use. The reciprocating or rotary compressors are characterized by high performance or low cost, while the scroll compressors are characterized by high performance, low noise or low vibration.

FIG. 4 depicts a conventional scroll compressor which generally comprises a closed vessel 1 and a compression mechanism 2 accommodated within an upper portion of the closed vessel 1. The compression mechanism 2 includes a non-orbiting scroll 29 having a frame portion 29*a* and a non-orbiting end plate 29*b*, and an orbiting scroll 2*b* having an orbiting end plate. The non-orbiting scroll 29 also has a non-orbiting scroll wrap integrally formed with the non-orbiting end plate 29*b*, while the orbiting scroll 2*b* also has an orbiting scroll wrap integrally formed with the orbiting end plate, with the non-orbiting and orbiting scroll wraps being in engagement with each other. The orbiting scroll 2*b* has a shaft 2*c* integrally formed therewith and journaled in an eccentric bearing 6, which is in turn accommodated within a recess defined in an upper end portion of a crank shaft 5. An upper portion of the crank shaft 5 is supported by a bearing member 4 with which a thrust bearing 3 is integrally formed to axially support the orbiting scroll 2*b*. The bearing member 4 is sealingly secured at its peripheral portion to the closed vessel 1. An electric motor 7 is disposed below the bearing member 4 and is made up of a rotor 7*a* securely mounted on the crank shaft 5 and a stator 7*b* rigidly secured to the closed vessel 1 by shrink fitting. The crank shaft 5 is radially supported by a main bearing 8 interposed between it and the bearing member 4 and by an auxiliary bearing 23 disposed below the electric motor 7, and is driven by the electric motor 7 to cause the orbiting scroll 2*b* to undergo an orbiting motion relative to the non-orbiting scroll 29.

The closed vessel 1 is provided at its bottom portion with an oil storage portion 10 for storing lubricating oil 9 and at its side portion with a suction pipe 11 rigidly secured thereto for introducing refrigerant gas thereinto. The pressure of suction gas acts within the closed vessel 1. The bearing member 4 has an oil discharge conduit 12 defined therein for discharging the lubricating oil 9 which has lubricated and cooled the main bearing 8, the auxiliary bearing 23, the eccentric bearing 6, and the thrust bearing 3. The crank shaft 5 has a through-hole 13 defined therein along a longitudinal axis thereof for supplying the main bearing 8, the auxiliary bearing 23, the eccentric bearing 6, and the thrust bearing 3 with the lubricating oil 9 to lubricate and cool them. The crank shaft 5 also has an oil guide 14 mounted on a lower end thereof by press fitting or shrink fitting for sucking up the lubricating oil 9 through the through-hole 13. The closed vessel 1 has a discharge chamber 15 defined therein above the non-orbiting scroll 29.

The scroll compressor shown in FIG. 4 also includes a discharge pipe 16 rigidly secured to the closed vessel 1 for discharging compressed high-pressure gas to the outside of the closed vessel 1, a check valve 19 mounted on the frame portion 29*a* for preventing contrarotation of the orbiting scroll 2*b* when the scroll compressor is stopped, a valve guide 24 disposed above the check valve 19 and bolted to the frame portion 29*a* for restricting a vertical movement of the check valve 19, and an Oldham ring 20 for preventing the orbiting scroll 2*b* from rotating about its own axis while permitting it to undergo an orbiting motion relative to the non-orbiting scroll 29.

The frame portion 29*a* of the non-orbiting scroll 29 is bolted to the bearing member 4, but is spaced a predetermined distance therefrom by means of a plurality of, for example, four, guide posts 30. The guide posts 30 are loosely inserted in associated guide holes 29*c* defined in the non-orbiting end plate 29*b* so as to allow an axial movement of the non-orbiting scroll 29.

The scroll compressor of the above-described construction operates as follows.

A low-pressure gas is first introduced into the closed vessel 1 through the suction pipe 11 and then into the compression mechanism 2. An orbiting motion of the orbiting scroll 2*b* relative to the non-orbiting scroll 29 compresses the low-pressure suction gas into a high-pressure gas, which is in turn introduced into the discharge chamber 15. The high-pressure gas thus obtained is discharged to the outside of the closed vessel 1 through the discharge pipe 16 to operate a working part. Upon operation of the working part, the high-pressure gas is turned into a low-pressure gas, which is returned back to the suction pipe 11, thus forming a known compression cycle.

On the other hand, lubricating oil 9 sucked up by the oil guide 14 moves upwardly along the through-hole 13 defined in the crank shaft 5, and lubricates and cools the auxiliary bearing 23, the eccentric bearing 6, the thrust bearing 3, and the main bearing 8. Thereafter, the lubricating oil 9 is discharged above the stator 7*b* through the oil discharge conduit 12 and is eventually returned back to the oil storage portion 10 through a groove 18 defined in the stator 7*b*, thus forming a known lubrication cycle.

In general, the refrigerant gas contains chlorine, while the lubricating oil 9 is based on mineral oil. This combination enhances the lubricating properties.

It is known that the compression efficiency is enhanced by reducing leakage of compressed gas at the free ends of the non-orbiting and orbiting scroll wraps.

Anderson et al. (U.S. Pat. No. 5,156,539) discloses a scroll machine having an axially movable non-orbiting scroll. The non-orbiting scroll has a plurality of circumferentially spaced mounting bosses each having an axial bore in which a sleeve bolted to a main bearing housing is slidably disposed.

Japanese Laid-Open Patent Publication (unexamined) No. 4-314986 discloses a closed scroll compressor having an axial compliance mechanism for axially and radially biasing an orbiting scroll against a non-orbiting scroll. The non-orbiting scroll has a frame and an end plate axially movably mounted on the frame by a couple of pins, while the orbiting scroll has a drive plate and an end plate axially movably mounted on the drive plate by a couple of pins.

In each of the above-described constructions, if the non-orbiting scroll is not allowed to axially smoothly move relative to the orbiting scroll without creating any axial gap between the non-orbiting and orbiting scroll wraps, there occurs much leakage of compressed gas, which in turn results in an increase in temperature inside the compressor, thus damaging the compressor.

Furthermore, in order to obtain a desired performance, it is necessary to assemble the non-orbiting and orbiting scrolls with a predetermined phase difference held therebetween. During a compression stroke, if this phase difference and an orbiting radius are not maintained unchanged and if the compression mechanism cannot be readily assembled, an efficient and inexpensive scroll compressor allowing a smooth axial movement of the non-orbiting scroll cannot be expected.

Although in the scroll compressor shown in FIG. 4 the non-orbiting scroll 29 is allowed to axially move along the guide posts 30, if the circumferential pitch of the guide posts 30 does not coincide with that of the guide holes 29*c* of the non-orbiting end plate 29*b*, the non-orbiting scroll 29 cannot smoothly move in the axial direction. The same is true for the case where even one of the plurality of guide posts 30 is not secured perpendicular to the bearing member 4. In such cases, it takes a lot of time and costs much to assemble the compression mechanism and to machine the surface of the bearing member 4 and the end surfaces of the guide posts 30.

Moreover, if the external diameters of the guide posts 30 do not match the internal diameters of the guide holes 29*c*, it is difficult to accurately position the non-orbiting end plate 29*b* in both the radial and circumferential directions, thus preventing a smooth axial movement of the non-orbiting scroll 29.

In consideration of machining and assembling errors, it is possible to make the internal diameters of the guide holes 29*c* considerably greater than the external diameters of the guide posts 30. In this case, however, the movement of the non-orbiting scroll wrap relative to the orbiting scroll wrap during compression greatly varies in both the radial and circumferential directions, thus lowering the compressor efficiency. In addition, when the guide posts 30 are mounted on the bearing member 4, it is necessary to pay close attention to engage the non-orbiting and orbiting scroll wraps with each other with a predetermined phase difference held therebetween, resulting in an increase in manufacturing cost.

SUMMARY OF THE INVENTION

The present invention has been developed to overcome the above-described disadvantages.

It is accordingly an objective of the present invention to provide a highly efficient scroll compressor capable of restraining an undesirable phase variation of the non-orbiting and orbiting scroll wraps during compression and of making an axial movement of the non-orbiting end plate smooth.

Another objective of the present invention is to provide the scroll compressor of the above-described type which is simple in construction and can be readily manufactured at a low cost.

In accomplishing the above and other objectives, the scroll compressor according to the present invention has a closed vessel, a compression mechanism accommodated in the closed vessel and including a non-orbiting scroll and an orbiting scroll in engagement with each other, and a drive means for driving the compression mechanism. The non-orbiting scroll comprises a frame portion and a non-orbiting end plate axially movable relative to the frame portion. The frame portion has a recess defined therein and a pin secured thereto. The non-orbiting end plate has a cylindrical wall integrally formed therewith and loosely received in the recess, thereby radially positioning the non-orbiting end plate relative to the frame portion. The non-orbiting end plate also has a recess defined therein in which the pin is loosely received, thereby circumferentially positioning the non-orbiting end plate relative to the frame portion. The pin is hardened so as to have a Rockwell hardness of more than 35 on scale C and has a chemical compound layer deposited thereon.

The closed vessel may contain chlorine-free fluorinated hydrocarbon refrigerant gas and polyol ester oil-based lubricating oil.

Advantageously, the chemical compound layer is formed by nitriding.

Alternatively, the chemical compound layer is formed by ion plating. In this case, the chemical compound layer is made of chromium nitride, titanium nitride, titanium carbide, high-hardness diamond-like carbon crystal, or titanium carbonitride.

Again alternatively, the chemical compound layer is formed by plating. In this case, the chemical compound layer is made of hard chromium, nickel, or nickel boron.

The pin may be secured to the non-orbiting end plate, while the recess for receiving the pin therein may be formed in the frame portion.

By the above-described construction, contact between the pin and the internal wall surface of the recess is not iron-to-iron contact but contact between iron and a chemical compound other than iron, thereby minimizing wear of the contact portions. Accordingly, the positional relationship of the non-orbiting end plate relative to the frame portion in the circumferential direction is maintained unchanged and, hence, the phase difference between the non-orbiting and orbiting scroll wraps is maintained at a predetermined value for a long time, ensuring a desired compression and enabling a highly reliable and efficient scroll compressor.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
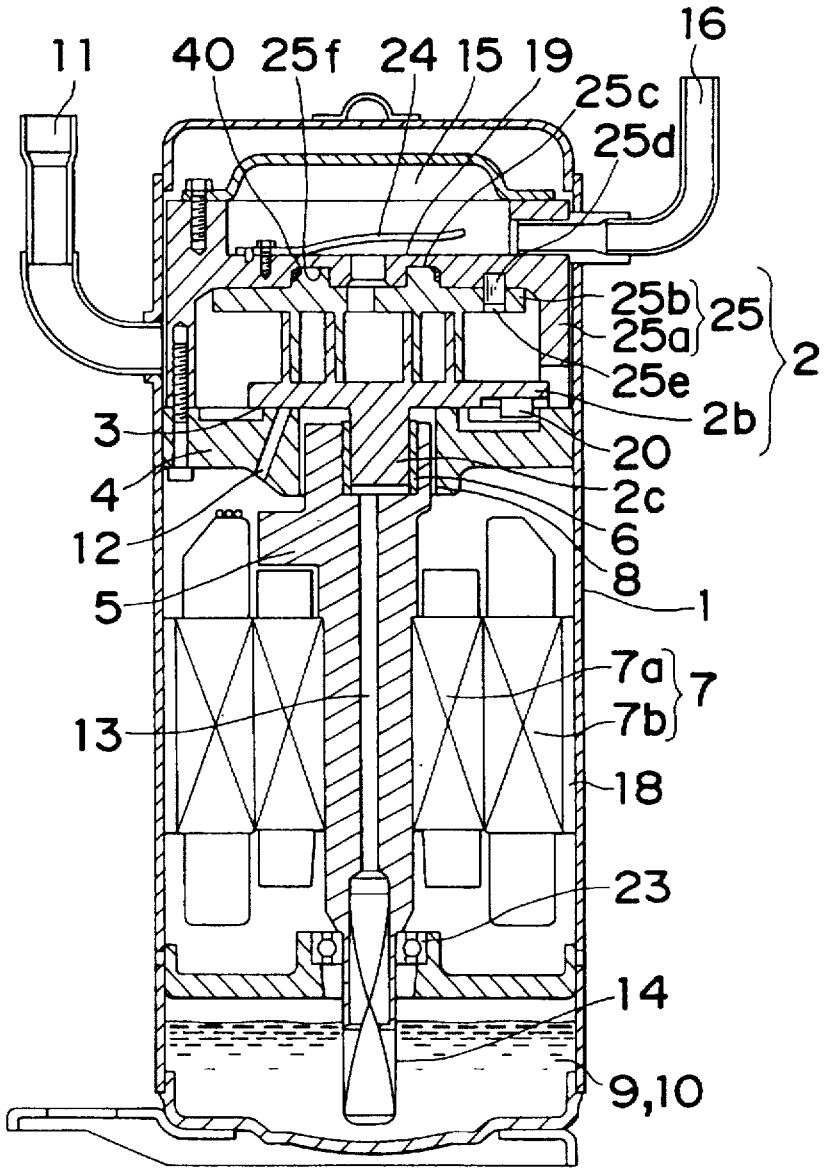
FIG. 1 is a vertical sectional view of a scroll compressor according to the present invention.

Referring now to the drawings, there is shown in FIG. 1 a scroll compressor embodying the present invention. The scroll compressor shown therein comprises a closed vessel 1 and a compression mechanism 2 accommodated within an upper portion of the closed vessel 1. The compression mechanism 2 includes a non-orbiting scroll 25 having a frame portion 25*a* and a non-orbiting end plate 25*b*, and an orbiting scroll 2*b* having an orbiting end plate. The non-orbiting scroll 25 also has a non-orbiting scroll wrap integrally formed with the non-orbiting end plate 25*b*, while the orbiting scroll 2*b* also has an orbiting scroll wrap integrally formed with the orbiting end plate, with the non-orbiting and orbiting scroll wraps being in engagement with each other. The non-orbiting scroll 25 further has a cylindrical wall 25*c* integrally formed with the non-orbiting end plate 25*b* so as to extend upwardly therefrom. The frame portion 25*a* of the non-orbiting scroll 25 has a downwardly open cylindrical recess 25*f* defined therein to axially slidably receive the cylindrical wall 25*c*. The center of the cylindrical wall 25*c* is aligned with that of the non-orbiting end plate 25*b*, while the center of the cylindrical recess 25*f* is aligned with that of the frame portion 25*a*. The frame portion 25*a* has a pin 25*d* pressed or shrink-fitted thereinto and loosely received in a round recess 25*e* defined in the non-orbiting end plate 25*b*, thereby circumferentially positioning the non-orbiting end plate 25*b* relative to the frame portion 25*a*.

The orbiting scroll 2*b* has a shaft 2*c* integrally formed therewith and journaled in an eccentric bearing 6, which is in turn accommodated within a recess defined in an upper end portion of a crank shaft 5. An upper portion of the crank shaft 5 is supported by a bearing member 4 with which a thrust bearing 3 is integrally formed to axially support the orbiting scroll 2*b*. The frame portion 25*a* of the non-orbiting scroll 25 is bolted to the bearing member 4. An electric motor 7 is disposed below the bearing member 4 and is made up of a rotor 7*a* securely mounted on the crank shaft 5 and a stator 7*b* rigidly secured to the closed vessel 1 by shrink fitting. The crank shaft 5 is radially supported by a main bearing 8 interposed between it and the bearing member 4 and by an auxiliary bearing 23 disposed below the electric motor 7. The crank shaft 5 is driven by the electric motor 7 to cause the orbiting scroll 2*b* to undergo an orbiting motion relative to the non-orbiting scroll 25.

The closed vessel 1 is provided at its bottom portion with an oil storage portion 10 for storing lubricating oil 9 and at its side portion with a suction pipe 11 rigidly secured thereto for introducing gas thereinto. The pressure of suction gas acts within the closed vessel 1. The bearing member 4 has an oil discharge conduit 12 defined therein for discharging the lubricating oil 9 which has lubricated and cooled the main bearing 8, the auxiliary bearing 23, the eccentric bearing 6, and the thrust bearing 3. The crank shaft 5 has a through-hole 13 defined therein along a longitudinal axis thereof for supplying the main bearing 8, the auxiliary bearing 23, the eccentric bearing 6, and the thrust bearing 3 with the lubricating oil 9 to lubricate and cool them. The crank shaft 5 also has an oil guide 14 mounted on a lower end thereof by press fitting or shrink fitting for sucking up the lubricating oil 9 through the through-hole 13. The closed vessel 1 has a discharge chamber 15 defined therein above the non-orbiting scroll 25.

The scroll compressor also includes a discharge pipe 16 rigidly secured to the closed vessel 1 for discharging compressed high-pressure gas to the outside of the closed vessel 1, a check valve 19 mounted on the frame portion 25*a* for preventing contrarotation of the orbiting scroll 2*b* when the scroll compressor is stopped, a valve guide 24 disposed above the check valve 19 and bolted to the frame portion 25*a* for restricting a vertical movement of the check valve 19, and an Oldham ring 20 for preventing the orbiting scroll 2*b* from rotating about its own axis while permitting it to undergo an orbiting motion relative to the non-orbiting scroll 25.

The scroll compressor of the above-described construction operates as follows.

A low-pressure gas is first introduced into the closed vessel 1 through the suction pipe 11 and then into the compression mechanism 2. An orbiting motion of the orbiting scroll 2*b* relative to the non-orbiting scroll 25 compresses the low-pressure suction gas into a high-pressure gas, which is in turn introduced into the discharge chamber 15. The high-pressure gas thus obtained is discharged to the outside of the closed vessel 1 through the discharge pipe 16 to operate a working part. Upon operation of the working part, the high-pressure gas is turned into a low-pressure gas, which is returned back to the suction pipe 11, thus forming a known compression cycle.

The high-pressure gas discharged from the discharge hole D of the end plate 25*b* is applied to the upper surface of the non-orbiting end plate 25*b* via the space S (see FIG. 2) inside the cylindrical wall 25*c*, and this high-pressure gas biases the non-orbiting scroll 25 towards the orbiting scroll 2*b* against the gas pressure inside working chambers defined between the non-orbiting and orbiting scroll wraps to reduce an axial gap between the non-orbiting and orbiting scroll wraps. To this end, a sealing element 40 is interposed between an external wall surface of the cylindrical recess 25*f* and that of the cylindrical wall 25*c*. A compression spring may be interposed between the frame portion 25*a* and the non-orbiting end plate 25*b* to bias the non-orbiting scroll 25 towards the orbiting scroll 2*b*.

It is to be noted here that although in FIG. 1 the pin 25*d* is illustrated as being secured to the frame portion 25*a*, the pin 25*d* may be secured to the non-orbiting end plate 25*b*. In this case, the frame portion 25*a* is required to have a round recess for receiving the pin therein.

Figure 2:
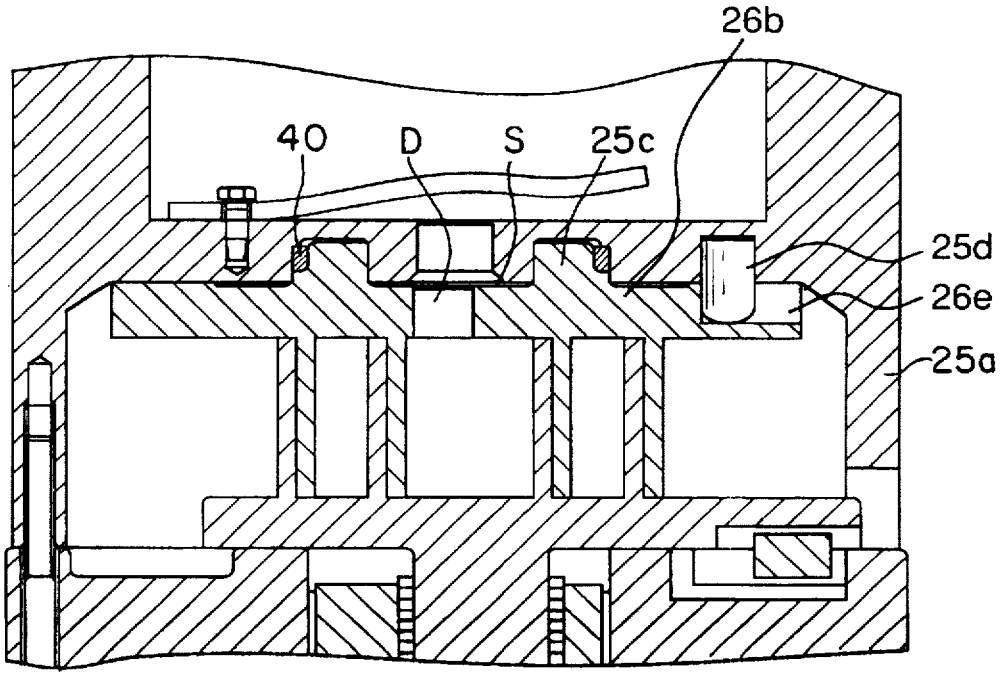
FIG. 2 is a vertical sectional view of a compression mechanism mounted in the scroll compressor of FIG. 1.
Figure 3:
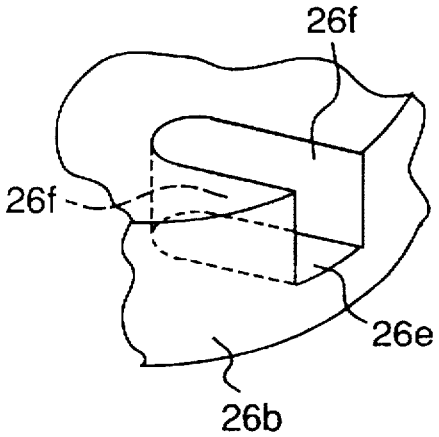
FIG. 3 is a fragmentary perspective view of a radially elongated recess defined in a non-orbiting end plate shown in FIG. 2.
Figure 4:
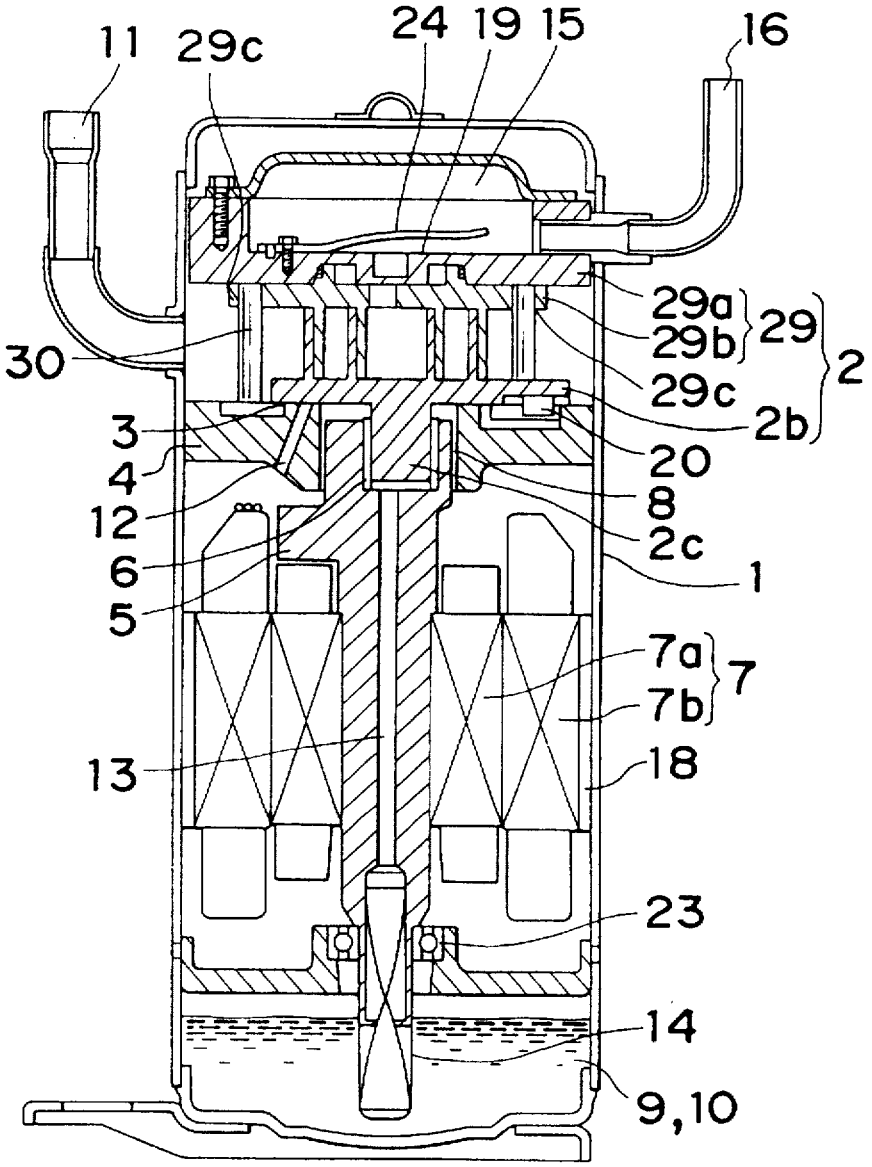
Fig. 4 PRIOR ART
FIG. 4 is a vertical sectional view of a conventional scroll compressor.

It is also to be noted that although in the above-described embodiment the recess 25*e* has been described as being round, it may be a radially elongated recess 26*e* having opposing straight side walls 26*f* extending parallel to each other, as shown in FIGS. 2 and 3. The pin 25*d* secured to the frame portion 25*a* is loosely inserted into the elongated recess 26*e* to circumferentially position the non-orbiting end plate 26*b*.

Because the recess 26*e* for receiving the pin 25*d* therein is radially elongated, it is sufficient if the pin 25*d* is accurately positioned on the frame portion 25*a* in only the circumferential direction thereof.

In the above-described embodiment, the non-orbiting end plate 25*b* is radially positioned and is allowed to axially move relative to the frame portion 25*a* with a radial clearance defined between the cylindrical wall 25*c* and the cylindrical recess 25*f*. The radial clearance, though small, allows the non-orbiting end plate 25*b* to slightly radially move relative to the frame portion 25*a* during a compression stroke. Although a considerably small radial movement of the non-orbiting end plate 25*b* does not hinder the operation of the compressor, one radial movement occurs for every rotation of the crank shaft 5 and, hence, a maximum of more than 9,000 radial movements may occur for one minute. Accordingly, the stopper pin 25*d* repeatedly slightly slides on the internal wall surface of the round or elongated recess 25*e* or 26*e*, and the sliding portions are subject to wear. Furthermore, when polyol ester oil-based lubricating oil is used in combination with fluorinated hydrocarbon refrigerant gas containing no chlorine, the lubricating properties are lowered, compared with the conventional case wherein mineral oil-based lubricating oil is generally used in combination with chlorine-containing refrigerant gas. Such wear of the sliding portions of the pin 25*d* and the recess 25*e* or 26*e* causes a deviation in phase difference between the non-orbiting and orbiting scrolls 25 and 2*b*, which deviation in turn causes leakage of the compressed gas from between the non-orbiting and orbiting scroll wraps, resulting in an increase in temperature inside the compressor and a reduction in reliability.

In view of the above, the pin 25d is hardened so as to have a Rockwell hardness of more than 35 on scale C. In addition, the pin 25d has a chemical compound layer deposited thereon by nitriding such as, for example, tufftriding (tufftride salt bath nitriding). The chemical compound layer is made of, for example, chromium carbonitride. This treatment minimizes wear of the sliding portions, which may be caused by iron-to-iron adhesion if an iron-made pin is not subjected to such a treatment. The hardened pin 25d having the chemical compound layer on its surface allows the non-orbiting end plate 25b to axially smoothly move relative to the frame portion 25a to considerably reduce leakage of the compressed gas at the free ends of the non-orbiting and orbiting scroll wraps, resulting in a highly reliable and efficient scroll compressor.

Alternatively, the chemical compound layer is deposited on the surface of the pin 25d by ion plating. The chemical compound layer is made of, for example, chromium nitride, titanium nitride, titanium carbide, high-hardness diamond-like carbon crystal, or titanium carbonitride.

Again alternatively, the chemical compound layer is deposited on the surface of the pin 25d by plating. In this case, the chemical compound layer is made of, for example, hard chromium, nickel, or nickel boron.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A scroll compressor having a closed vessel, a compression mechanism accommodated in the closed vessel and including a non-orbiting scroll and an orbiting scroll in engagement with each other, and a drive mechanism for driving the compression mechanism, wherein:

said non-orbiting scroll comprises a frame portion and a non-orbiting end plate axially movable relative to said frame portion;

said frame portion has a first recess defined therein and a pin secured thereto;

said non-orbiting end plate has a cylindrical wall integrally formed therewith and loosely received in said first recess, thereby radially positioning said non-orbiting end plate relative to said frame portion;

said non-orbiting end plate has a second recess defined therein in which said pin is loosely received, thereby circumferentially positioning said non-orbiting end plate relative to said frame portion; and said pin is itself hardened so as to have a Rockwell hardness of more than 35 on a scale C, and has a chemical compound layer deposited thereon.

2. The scroll compressor according to claim 1, wherein said chemical compound layer is formed by nitriding.

3. The scroll compressor according to claim 1, wherein said chemical compound layer is formed by ion plating.

4. The scroll compressor according to claim 3, wherein said chemical compound layer is made of chromium nitride.

5. The scroll compressor according to claim 3, wherein said chemical compound layer is made of titanium nitride.

6. The scroll compressor according to claim 3, wherein said chemical compound layer is made of titanium carbide.

7. The scroll compressor according to claim 3, wherein said chemical compound layer is made of high-hardness diamond-like carbon crystal.

8. The scroll compressor according to claim 3, wherein said chemical compound layer is made of titanium carbonitride.

9. The scroll compressor according to claim 1, wherein said chemical compound layer is formed by plating.

10. The scroll compressor according to claim 9, wherein said chemical compound layer is made of hard chromium.

11. The scroll compressor according to claim 9, wherein said chemical compound layer is made of nickel.

12. The scroll compressor according to claim 9, wherein said chemical compound layer is made of nickel boron.

13. The scroll compressor according to claim 1, wherein said closed vessel contains refrigerant gas containing no chlorine.

14. The scroll compressor according to claim 13, wherein said refrigerant gas contained in said closed vessel comprises fluorinated hydrocarbon refrigerant gas, and said closed vessel further contains polyol ester oil-based lubricating oil.

15. A scroll compressor having a closed vessel, a compression mechanism accommodated in the closed vessel and including a non-orbiting scroll and an orbiting scroll in engagement with each other, and a drive mechanism for driving the compression mechanism, wherein:

said non-orbiting scroll comprises a frame portion and a non-orbiting end plate axially movable relative to said frame portion;

said frame portion has first and second recesses defined therein;

said non-orbiting end plate has a cylindrical wall integrally formed therewith and loosely received in said first recess, thereby radially positioning said non-orbiting end plate relative to said frame portion;

said non-orbiting end plate has a pin secured thereto which is loosely received in said second recess, thereby circumferentially positioning said non-orbiting end plate relative to said frame portion; and said pin is itself hardened so as to have a Rockwell hardness of more than 35 on scale C, and has a chemical compound layer deposited thereon.

16. The scroll compressor according to claim 15, wherein said chemical compound layer is formed by nitriding.

17. The scroll compressor according to claim 15, wherein said chemical compound layer is formed by ion plating.

18. The scroll compressor according to claim 17, wherein said chemical compound layer is made of chromium nitride.

19. The scroll compressor according to claim 17, wherein said chemical compound layer is made of titanium nitride.

20. The scroll compressor according to claim 17, wherein said chemical compound layer is made of titanium carbide.

21. The scroll compressor according to claim 17, wherein said chemical compound layer is made of high-hardness diamond-like carbon crystal.

22. The scroll compressor according to claim 17, wherein said chemical compound layer is made of titanium carbonitride.

23. The scroll compressor according to claim 15, wherein said chemical compound layer is formed by plating.

24. The scroll compressor according to claim 23, wherein said chemical compound layer is made of hard chromium.

25. The scroll compressor according to claim 23, wherein said chemical compound layer is made of nickel.

26. The scroll compressor according to claim 23, wherein said chemical compound layer is made of nickel boron.

27. The scroll compressor according to claim 15, wherein said closed vessel contains refrigerant gas containing no chlorine.

28. The scroll compressor according to claim 27, wherein said refrigerant gas contained in said closed vessel comprises fluorinated hydrocarbon refrigerant gas, and said closed vessel further contains polyol ester oil-based lubricating oil.

* * * * *